United States Patent [19]

Dunton et al.

[11] Patent Number: 4,789,244

[45] Date of Patent: Dec. 6, 1988

[54] APPARATUS AND METHOD TO PRODUCE FOAM, AND FOAMED CONCRETE

[75] Inventors: Harvey R. Dunton, Victorville; Donald H. Rez, Newport Beach, both of Calif.

[73] Assignee: Standard Concrete Materials, Inc., Santa Ana, Calif.

[21] Appl. No.: 37,007

[22] Filed: Apr. 10, 1987

Related U.S. Application Data

[63] Continuation-in-part of Ser. No. 3,028, Jan. 12, 1987.

[51] Int. Cl.[4] ..... B28C 5/06

[52] U.S. Cl. ..... 366/12; 366/19; 366/30; 366/101; 366/160

[58] Field of Search ..... 366/160, 150, 162, 156, 366/177, 176, 182, 136, 251, 137, 270, 134, 192, 178, 165, 2, 10, 12, 66, 101, 30, 64, 138, 19, 141, 30, 67, 193, 101, 105; 422/133, 134, 236; 425/59, 46; 264/69

[56] References Cited

U.S. PATENT DOCUMENTS

| | | | |
|---|---|---|---|
| 2,432,971 | 12/1947 | Ruthman . | |
| 2,549,507 | 4/1951 | Morgan et al. . | |
| 2,600,018 | 6/1952 | Nelson et al. . | |
| 2,629,667 | 2/1953 | Kaveler . | |
| 2,700,615 | 1/1955 | Heijmer . | |
| 2,820,713 | 1/1958 | Wagner . | |
| 2,959,489 | 11/1960 | Wagner . | |
| 3,030,258 | 4/1962 | Wagner . | |
| 3,169,877 | 2/1965 | Bartoli . | |
| 3,215,549 | 11/1985 | Ericson et al. . | |
| 3,967,815 | 7/1976 | Backus et al. | 366/64 |
| 4,039,170 | 8/1977 | Cornwall et al. | 366/29 X |
| 4,185,923 | 1/1980 | Bouette et al. | 366/10 |
| 4,199,547 | 4/1980 | Levinsky et al. | 366/182 X |
| 4,275,033 | 6/1981 | Schulte et al. | 422/133 |
| 4,328,178 | 5/1982 | Kossatz | 264/69 |
| 4,372,352 | 2/1983 | Coppola et al. | 366/2 |
| 4,448,536 | 5/1984 | Strong | 366/66 |
| 4,599,208 | 7/1986 | Blaak | 261/83 |
| 4,705,405 | 11/1987 | Williams | 366/160 |

*Primary Examiner*—Timothy F. Simone
*Attorney, Agent, or Firm*—William W. Haefliger

[57] ABSTRACT

A method for forming foam, useful in mixing with concrete at a batching plant, includes the steps:

(a) supplying a synthetic resinous foaming agent, in liquid form, (b) combining the foaming agent with water, to form a liquid mix, and pressurizing the mix, (c) adding pressurized gas to the mix, (d) sub-dividing the mix into droplets, in a confined flowing stream, (e) reducing the stream confinement, (f) whereby the droplets expand as foam, typically consisting of individual, gas filled bubbles.

8 Claims, 3 Drawing Sheets

APPARATUS AND METHOD TO PRODUCE FOAM, AND FOAMED CONCRETE

BACKGROUND OF THE INVENTION

This application is a continuation in part of Ser. No. 3, 028, filed Jan. 12, 1987.

This invention relates generally to production and use of foam in concrete mixes, and more particularly to an efficient, simple process of producing foam used for example at batching plants, as well as apparatus to provide such foam.

It is known to employ foam in concrete to improve its use characteristics; however, it is difficult to provide and maintain correct ratios of foam producing agent in water supplied to the dry concrete mix, and correct ratios of foam to concrete, particularly at the job site, and it is found that such ratios can and do vary greatly at different job sites whereby the quality, pumpability, extrudability, and finishing characteristics of the concrete vary and suffer. There is need for simple, low cost, and effective apparatus and method to provide required quality control of the ratios referred to and enable production of high quality concrete in terms of pumpability, extrudability weight control, insulative and fire proofing capability, as well as other desirable qualities.

SUMMARY OF THE INVENTION

It is a major object of the invention to provide method and process apparatus, overcoming the above difficulties and problems, and providing for efficient metering and blending of foam producing chemical with water or other aqueous fluids, and mixing with gas such as air under pressure, to produce foam added to concrete mix, as at a batching plant, in correct ratio. The method may be categorized as including the steps:

(a) supplying a synthetic resinous foaming agent, in liquid form, (b) combining the foaming agent with water, to form a liquid mix, and pressurizing the mix, (c) adding pressurized gas such as air to the mix, (d) sub-dividing the mix into droplets, in a confined flowing stream, (e) and reducing the stream confinement, (f) whereby the droplets expand a foam, typically consisting of individual, gas filled bubbles.

As will be seen, the combining of foaming agent chemical with water, or aqueous fluid, typically includes pumping the mix to form the flowing stream which is pressurized, through use of a double diaphragm, positive displacement, gas or air operated pump. Such a pump incorporates certain sub-chambers for reception of gas or air pressure to drive the pump, and other sub-chambers to receive water to be pumped, and in accordance with the invention fluid chemical metering means is provided to operate in synchronism with the pump to feed chemical to water being pumped. As will appear, the metering means may also comprise a positive displacement pump, reciprocated in response to water flow to and from the diaphragm pump, thereby to feed metered quantities of chemical in correct proportion to the water being pumped. Foam is not produced at the pump or is mixed with the pre-mixed chemical foaming agent and water. Where air is referred to herein, it will be understood to extend to other gas or gases.

Further, the chemical and water that has been pumped at established ratios, can be kept separated and diverted to a transparent, calibrated container for visual check of exact amounts of each material, prior to discharging into the blending unit. The blending or discharging cycle is the same as the charging cycle, except the chemical, water and gas or air are, by valve selection, pumped from the sight container and combined through static mixing chambers to produce the required density and volume of micro-spheres. The blending chambers contain filter elements in the range of 5 to 25 microns in fineness, i.e. size.

Further, the pressurized gas or air used for driving the pump, and exhausted from the pump, is typically recovered and used as a source of gas or air blended with the water-chemical mix, thereby to control the air to water, and chemical mix ratios for accurate and reliable production of foam productive of micro-sphere aggregates when added to concrete at the batching plant; such foam improves concrete pumpability and extrusion; it improves concrete finishing, insulation and stucco products; and it enhances concrete fire proofing capability. The process and system furthermore provide the following advantages:

1. enhances aggregate benefaction and or replacement in concrete;

2. provides a placing , pumping, and finishing aid, for concrete;

3. assists in the concrete curing process during the hydration phases, i.e. reduction in volume change, or shrinkage, creating reduced normal cracking and increasing strength in concrete;

4. provides reduced water demand for the same consistency of plastic concrete, creating lower water to cement ratios;

5. useful in refractory type concretes with aluminate type cements;

6. useful in sound and thermal resistant, insulative type concretes;

7. enhances resistance of concrete to freezing and thawing cycles under more severe climatic conditions due to the internal void system created by the micro-spheres;

8. allows reduction of weight in structural concretes.

The system for metering and blending the various components into micro-spheres is typically inter-faced with a computerized batching console in a concrete related manufacturing operation making it completely automated.

These and other objects and advantages of the invention, as well as the details of an illustrative embodiment, will be more fully understood from the following specification and drawings, in which:

DRAWING DESCRIPTION

DETAILED DESCRIPTION

Figure 1:
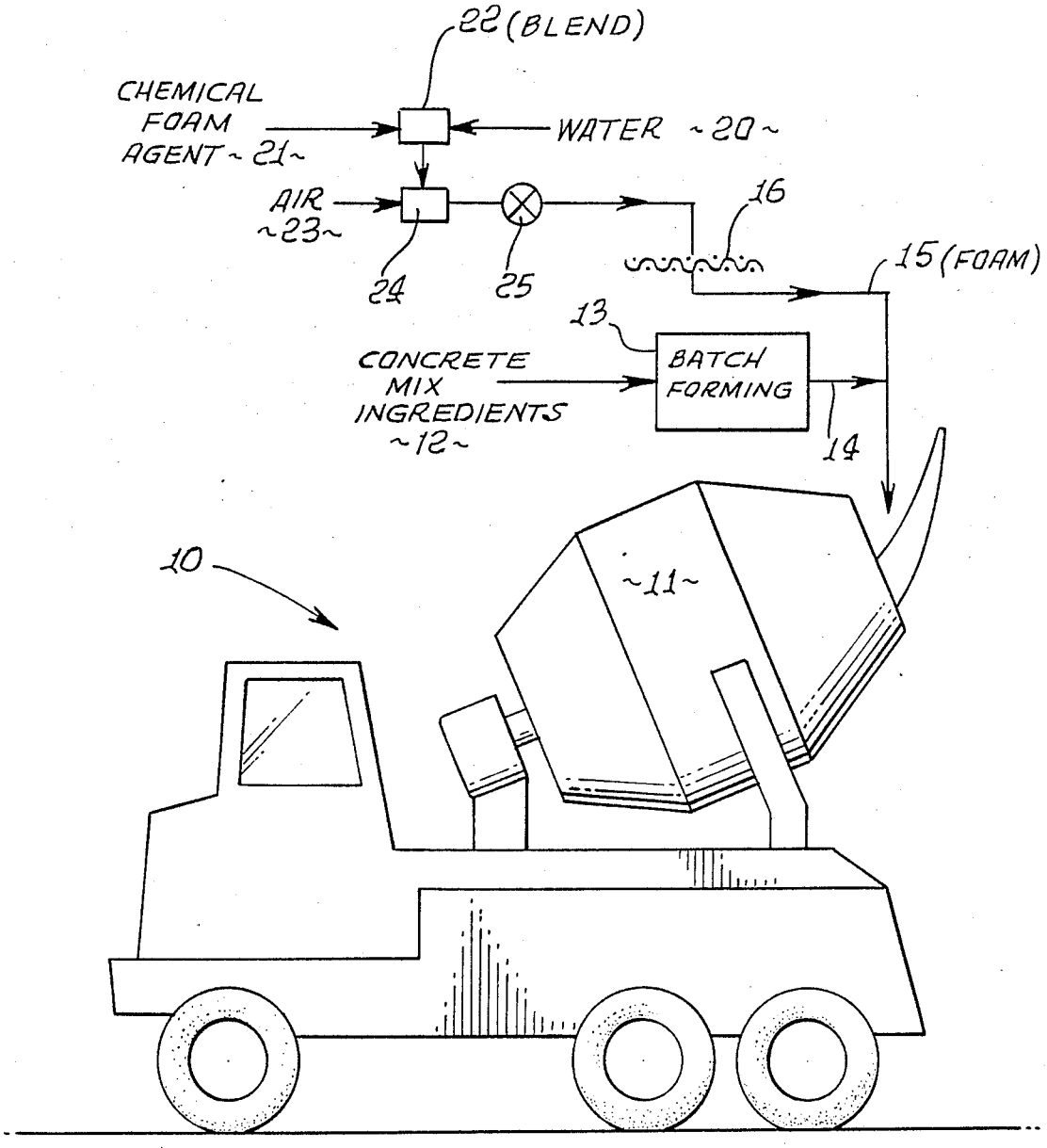
FIG. 1 is an elevation showing diagrammatically, the method of the invention as practiced at a concrete batching plant.

In FIG. 1 a concrete mixing truck 10 incorporates a truck body, and a rotating concrete mixing drum 11, containing concrete to which foam has been added. Dry concrete ingredients 12 in correct proportions by weight are delivered to batcher 13, and then delivered at 14 to the drum 11. Foam is also produced and delivered at 15 to the drum, the foam forming as a mix of water and chemical foaming agent, containing compressed gas or air, is expanded through a mesh or screen 16. The foam contains or consists of individual, gas filled bubbles, of very small size as produced by the mesh. The correct amount of foam is determined for a given quantity of concrete ingredients admitted to the mixer, i.e. foam is metered, by employment of a reciprocating water or fluid pump (to be described) and a synchronuously operated foaming agent pump, together with a regulated air supply, so that a metered number of pulses or reciprocations produce the required correct quantity of foam, in correct ratio to concrete, so as to ensure the desired high quality concrete. This effect is further enhanced through use of a resinous chemical foaming agent such as 'CELLUCON' (essentially methyl cellulose) a product of Romaroda Chemicals Pty., Ltd., 226 Princes Highway Dandenong, Victoria, Australia.

In FIG. 1, pressurized water 20 and chemical foaming agent 21 are mixed at 22, and the mix is blended with air 23 under pressure, at zone mixing 24. The blend is then passed through pressure reducing control valve 25 and through a mesh or screen at 16 so that foam is produced characterized in that only the smaller i.e. micro sized spherical bubbles of foam pass to the concrete in the mix. Typically between ½ and 5 cubic feet of foam are added to each cubic yard of concrete, for best results. The bubbles in essence take the place of sand particles, volumetrically, to produce a lightweight concrete; the foam is of shaving cream or beaten egg white consistency, the bubbles being, for example, about 300 microns in diameter. Such lightweight concrete also undergoes less shrinkage than ordinary concrete, during curing.

Figure 2:
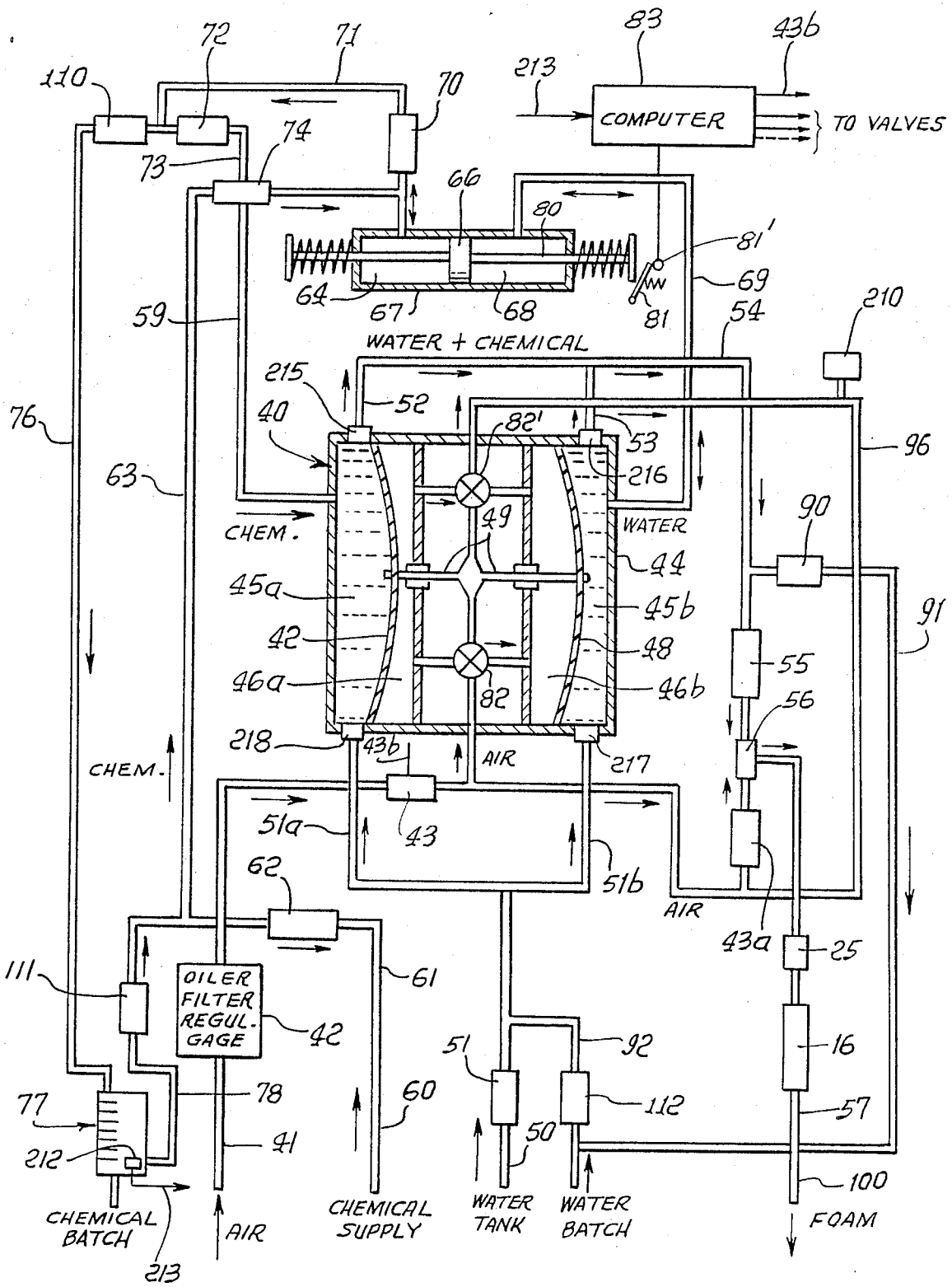
FIG. 2 is a flow diagram showing apparatus and method to produce foam for use in concrete.

In FIG. 2 a double displacement pump 40 is air pressure driven. Air under pressure is passed at 41 through an air pressure regulator 42 and through a valve 43 (controlled at **43*b* by a computer 83) to the pump 40. Typical delivered air pressure is about 80 psi. The pump includes. a housing 44 and two chambers 45 and 46. Diaphragms 42 and 48 divide the chambers into sub-chambers 45*a* and 45*b*, and 46*a* and 46*b*, The diaphragms are interconnected at 49 so that they reciprocate together. Air pressure is admitted to the two sub chambers 46*a* and 46*b* alternately to effect such reciprocation. See valves 82 and 82'**.

Water is supplied via line 50, valve 51 and lines **51*a* and 51*b* to the sub-chambers 45*a* and 45*b* alternately, and pumped from such chambers via lines 52 and 53 to a line 54 leading via valve 55 t mixer at 56; at the latter (corresponding to 24 above) water, with chemical added in correct ratio, mixes with pressurized air to pass through mesh at unit 16 to produce foam in line 57, to be added to a concrete mix and delivered to a mixer drum 11 for delivery to a job site. Note air supply from check valve 43 to adjustable valve 43*a*. Also, discharged air from chambers 46*a* and 46*b* flows via valve 82' and line 96 to valve 43*a* and to 56. Note pressure relief valve 210, in line 96. The pressurized air added to the water and chemical mix, under pressure, causes subdivision of the mix into droplets in a confined flowing stream, the droplets expanding in mesh unit 16 into foam. If desired, water may at times be drained from line 54 via shut-off valve 90 and line 91**.

A metered amount of foam producing chemical is supplied to water in sub-chamber **45*b* of the pump, via line 59. Such metering of the chemical is controlled by stroking of the pump diaphragm 42. For this purpose, chemical is supplied as at 60 to flow via line 61, valve 62, line 63 and valve 74 to the left chamber 64 as a piston 66 moves to the right in cylinder 67. Thus, enlargement of chamber 64 produces suction action to draw chemical into that chamber 64. In this regard, piston 66 is drawn to the right by withdrawal of water from right chamber 68, as pump diaphragm 48 moves to the left, there being a water line 69 connecting chamber 68 with pump sub-chamber 45*b*. Water also enters sub-chamber 45*b* via line 51*b*** at such time.

When diaphragm 48 moves to the right, water under pressure is ejected from sub-chamber **45*b* to flow to chamber 68, and also to flow at 53 to line 54**, as described above.

As piston 66 moves to the left, in response to pressurized water flow to right chamber 68, chemical is discharged from left chamber 64 to flow via valve 70 line 71, valve 72, line 73, and valve 74 to line 59 and to subchamber **45*a*, as described above. Chemical is also pumped via line 76 to a sight glass 77, for visual inspection of chemical quantity (i.e. to assure that chemical is always in supply at correct amount), and re-circulation at 78 to line 63**.

Each time piston 66 moves to the right, a piston rod 80 extending from the cylinder 67 activates a switch arm 81 to engage a contact 81', for producing a pulse fed to the computer indicated at 83. The latter counts the pulses, and controls the apparatus.

Once the predetermined number of pulses is counted by the computer, the measured quantity of concrete materials at batcher 13 is held in readiness for discharge to the draw chemical from the measuring sight glass 77 for supply to chamber **45*a*. This action continues and foam is generated and supplied to drum 11, as the concrete materials are also fed to the rotating drum. A level, sensing element 212 in the sight glass senses when the required amount of chemical has left the sight glass, and the computer is signaled via line 213** that the required chemical has been delivered to the mix.

More specifically, the computer counts the pulses up to that number corresponding to the volumetric amount of foam producing chemical to be added to sub chamber **45*a* (for example, 3 pulses correspond to ¾ ft.$^3$ of foam, which corresponds to ½ gallon of water). The measured amount On the charge cycle, valves 72, 111, 112, 55 and 43 are kept closed, and the following valves are opened, computer control, to effect chemical supply to the sight glass 77 (via 60, 62, 63, 74, 70, 71, 110 and 76), and to effect water by-pass flow via 90, 91 and 112, by-passing mixer 56**:

110 (chemical flow)
62 (chemical flow)
90 (water drain)
51 (water supply)

On the discharge cycle, valves 110, 62, 90 and 51 are closed, and the following valves are opened:

72 (chemical flow)
111 (chemical flow)
112 (water)
55 (water)
43 (air), thereby discharging chemical from the measuring sight glass 77 to flow via 78, 111, 63, 74, 70, 71, 72, 74 and 59 to sub-chamber 45*a*. Also, water and chemical flow via 54 and 55 to mixer 56 to mix with air and produce foam at 100, in FIG. 2.

Check valves are indicated at 215–218.

Figure 3:
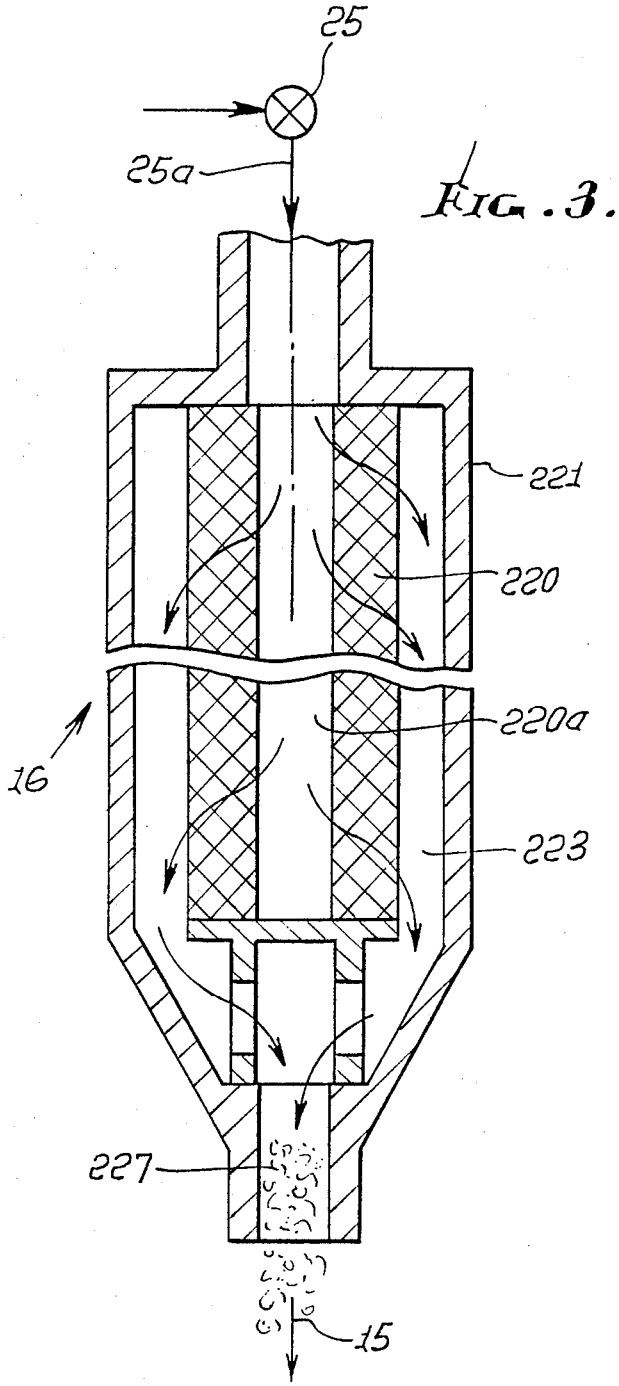
FIG. 3 is a section taken through foam producing apparatus.
Figure 4:
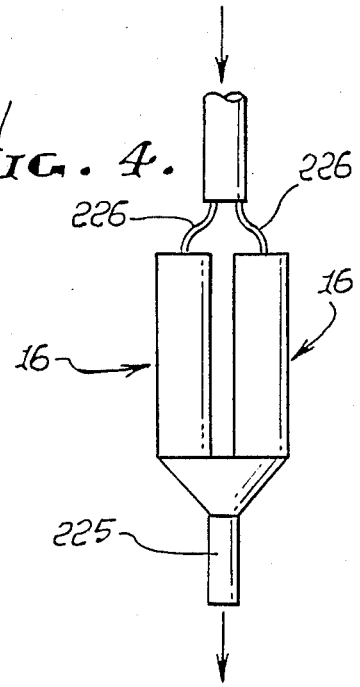
FIG. 4 is a side view of modified foam producing apparatus.

Referring now to the unit 16 seen in FIG. 3, a tubular mesh is shown at 220, and may consist of wound filament yarn. It is contained within a tubular body 221 having an inlet 226 for water and chemical via line 25*a*, as in FIG. 1, and an outlet 227 for foam, which forms as the water and chemical mixture passes and expands radially outwardly from the bore 220*a* of the tubular mesh, through the mesh interstices, to the annular exterior 223 about the tubular mesh. The foam leaves the unit at 15. A pressure drop occurs upon passage through the tightly compacted yarn windings, assisting foam flotation from sub-divided droplets formed in the mesh. In FIG. 4, two such units 16 are connected in parallel, these two outlets feeding foam to the nozzle outlet 225. Chemical and water mix is fed at 226 to the two units.

We claim:

1. A foam producing system, comprising:

(a) first and second means to supply a foaming agent and water, respectively, (b) pump means having an inlet connected to receive a mixture of said foaming agent and water, thereby to pressurize the mixture, the pump means also having an outlet, (c) and sub-dividing means connected with said outlet to receive the pressurized mixture, and to subdivide same into droplets, (d) whereby the droplets may expand as an aqueous foam, (e) recirpocating metering means operated in volumetric through-put relation to said pumping means for metering a flow of said foaming agent to water to be mixed therewith at the pump means, said pump means and said metering means being positive displacement devices operating in synchronism, (f) and said first means to supply foaming agent comprises a sight glass reservoir having an inlet and outlet via which a stream of said agent flows from said metering means to said pump means, via and in response to operation of said reciprocating metering means.

2. The system of claim 1 wherein each of said pump means and said metering means have reciprocating displacement elements operating in synchronism.

3. The system of claim 2 wherein said elements of the pump means comprise diaphragms.

4. The system of claim 2 wherein said pump means comprises at least one air pressure operated element reciprocating in a chamber or chambers, there being a connection or connections to flow the discharge air from said chamber or chambers to mix with intermixed water and foaming agent flowing from the pumping means outlet.

5. The system of claim 1 including a batching receptacle to which a concrete mix is also added in predetermined amount and from which concrete mix is supplied to a concrete mixing drum on a vehicle, along with foam in predetermined ratio to the concrete mix.

6. The system of claim 3 wherein said pump means includes housing structure containing said diaphragms, and sub-chambers formed by the diaphragms and housing structure, there being an air sub-chamber and a water chamber at opposite sides of each diaphragm, and a housing inlet via which foaming is fed from said sight glass reservoir to the water sub-chamber associated with one diaphragm, the water sub-chamber associated with the other diaphragm connected to said metering means to enable water pressure driving of the metering means.

7. The system of claim 1 wherein said sub-dividing means comprises a tubular mesh consisting of wound filament yarn and through which the mixture passes for generating the foam.

8. The system of claim 7 including a tubular body about said tubular mesh, and having an inlet and an outlet to pass the mix thru the mesh and to pass generated foam from the body outlet.

* * * * *